US007080827B1

(12) United States Patent
McCannon, Jr.

(10) Patent No.: US 7,080,827 B1
(45) Date of Patent: Jul. 25, 2006

(54) STONE FENCE

(75) Inventor: W. Allen McCannon, Jr., Elberton, GA (US)

(73) Assignee: McCannon Granite Company, Elberton, GA (US)

( * ) Notice: Subject to any disclaimer, the term of this patent is extended or adjusted under 35 U.S.C. 154(b) by 0 days.

(21) Appl. No.: 10/837,902

(22) Filed: May 3, 2004

(51) Int. Cl.
*E04H 17/14* (2006.01)

(52) U.S. Cl. ..... 256/19

(58) Field of Classification Search ..... 256/19, 256/64, 65.05, 59, 65.01, 65.02
See application file for complete search history.

(56) References Cited

U.S. PATENT DOCUMENTS

| | | | | | |
|---|---|---|---|---|---|
| 1,683 | A | | 7/1840 | Delisle | |
| 72,113 | A | | 10/1867 | Sweigert | |
| 240,843 | A | * | 5/1881 | Pontius | 403/381 |
| 1,896,297 | A | | 2/1933 | Fox | |
| 2,365,397 | A | | 12/1944 | Dickman | |
| 2,603,456 | A | | 7/1952 | Ruopp | |
| D174,787 | S | * | 5/1955 | Widman | D25/44 |
| 2,744,729 | A | | 5/1956 | Potts | |
| 3,298,868 | A | * | 1/1967 | Smith et al. | 429/115 |
| 4,272,060 | A | * | 6/1981 | Stafford | 256/24 |
| 4,733,851 | A | | 3/1988 | Weiss | |
| 5,253,932 | A | * | 10/1993 | Nesovic | 312/140.3 |
| 5,633,508 | A | | 5/1997 | Schleppenbach | |
| 5,649,784 | A | * | 7/1997 | Ricaud et al. | 404/47 |
| 5,836,572 | A | * | 11/1998 | Sugiyama | 256/19 |
| 6,185,888 | B1 | * | 2/2001 | Wasson | 52/300 |
| D465,286 | S | * | 11/2002 | Gregori | D25/38 |
| 6,601,831 | B1 | * | 8/2003 | Erwin | 256/65.05 |

* cited by examiner

*Primary Examiner*—Daniel P. Stodola
*Assistant Examiner*—Joshua T. Kennedy
(74) *Attorney, Agent, or Firm*—McNair Law Firm, P.A.

(57) ABSTRACT

A stone fence formed of a plurality of stone blocks and stone rails. Each block and each rail are formed with planar upper and lower surfaces and chipped outer side surfaces. The block are stacked with the planar surfaces in engagement forming fence post. At selected vertical heights, slots or cavities are formed on opposing sides of the post. The cavities receive end portions of the rails to retain the rails in spaced vertical positions.

The planar surfaces allow full surface contact which provides the necessary stability and area for securing the block and rails together.

6 Claims, 3 Drawing Sheets

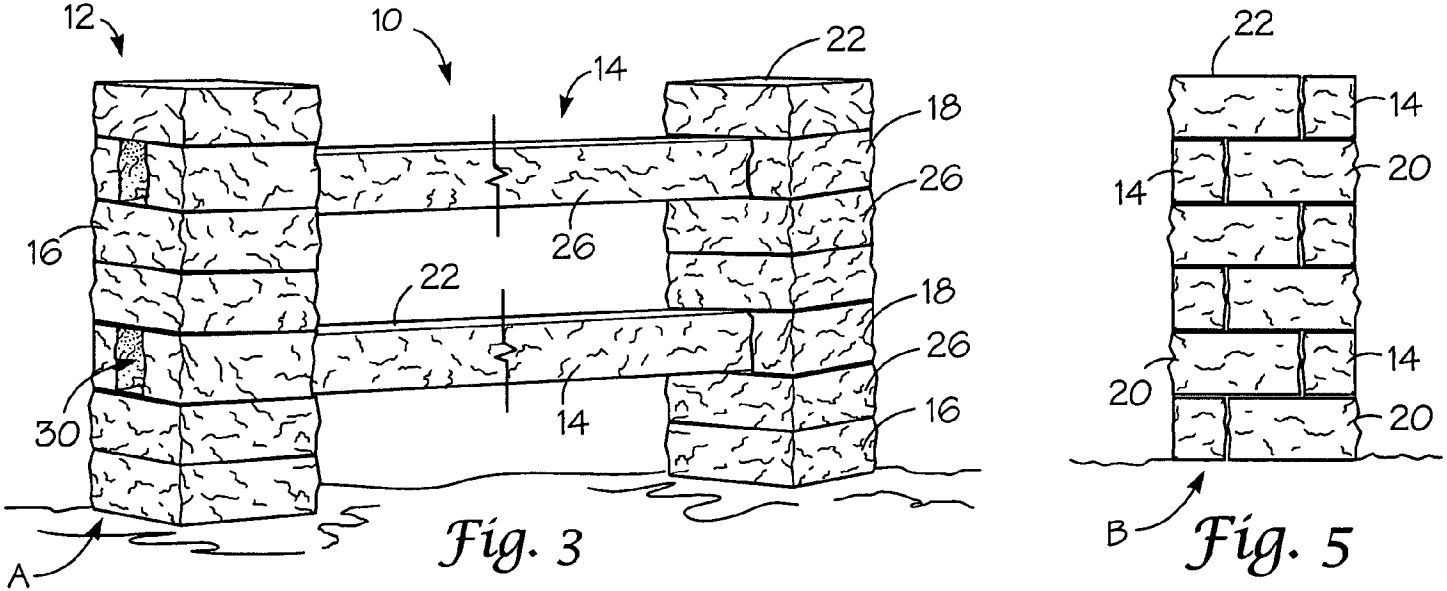
Fig. 3
Fig. 5
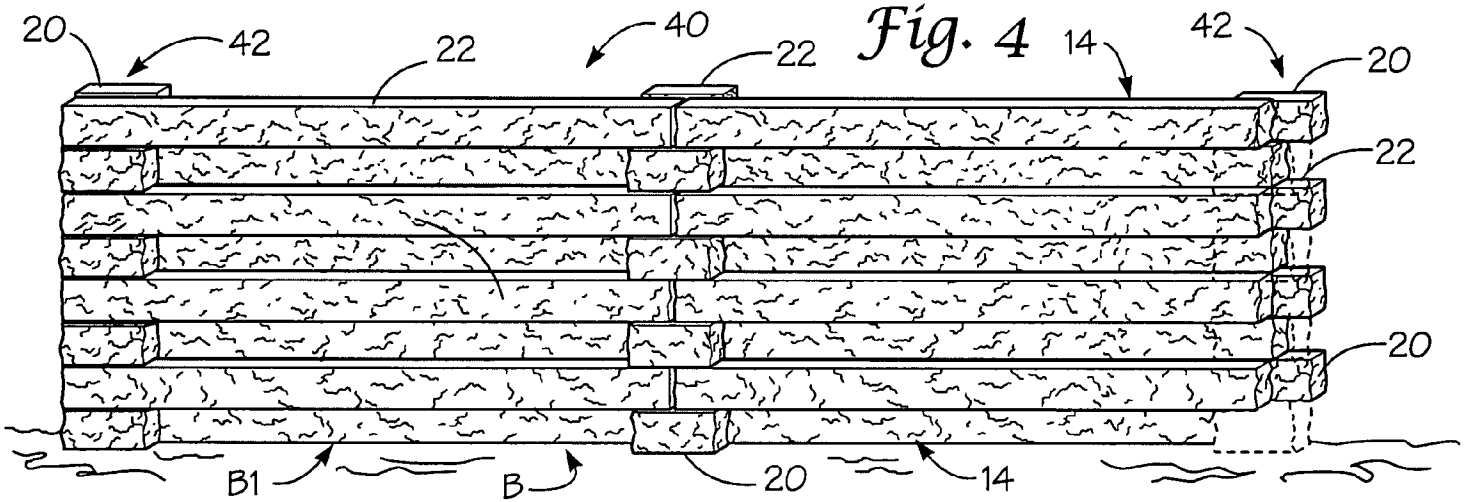
Fig. 4

STONE FENCE

BACKGROUND OF THE INVENTION

The instant invention is directed to a rail fence made completely of stone. Rail fences in and of themselves are hundreds of years old. However, none or substantially none of these hundreds of years old fences are still standing, as they were made of all wood or mostly wood, which over time, decays. A version of rail fencing made of metal pipes may have survived time, however, these type fences are not particularly acceptable due to their lack of aesthetic enhancement.

It is well established that stone, while enduring, provides beauty and charm other building materials are not capable of.

Accordingly, it is an object of this invention to provide a rail fence made of stone.

Another object of the invention is to provide a stone rail fence which is sturdy.

Another object of the invention is to provide a stone rail fence which is rustic in appearance and yet provides full contact between adjacent supported pieces.

Another object of the invention is a novel method of preparing stone blocks and rails for assembly.

Another object of the invention is the method of assembly of the prepared stone blocks and rails forming a sturdy and yet good looking fence.

SUMMARY OF THE INVENTION

The instant invention is directed to a stone rail fence formed of stacked stone blocks forming post which support granite rails. The blocks and rails are produced to have a smooth or planar upper and lower surfaces or faces. The outer faces or surfaces, which are the vertically extending faces, are produced with a chipped or non-planar rough surface.

The fence post are constructed by stacking blocks one on the other with the planar surfaces always in contact. Certain of the blocks are sized to be 6" high, 12" long and 18" wide.

The fence post utilizes between one and three of the 12"x18" blocks to extend from the foundation upward. A pair of the 6"x12" blocks are then utilized, at the selected vertical point, to form a slot. An end of a rail is positioned in the slot and supported by the post. Additional of the 6"x12" blocks are positioned over the rail end extending the post to a desired height before forming an additional slot. Additional rails are supported in the additional slots. It is noted that a second and identical post is formed about 8' from the first post for supporting the rails in parallel positions.

The planar surfaces of the blocks and rails provide engagement surfaces which result in the abutting blocks being stable and in full contact with each other.

The engaged supporting surfaces are normally permanently secured together with an acrylic compound. The acrylic compound forms a thin layer over the planar surfaces which tightly bonds them together without appearing on the outer sides of the blocks. This provides a totally natural appearance for the post and therefore, the fence. A suitable silicone is SILICONE BUILDING SEALANT CRL manufactured by C.R. Lawrence Co., Inc. There are other suitable sealants available which may also be used without departing from the scope of the invention.

The chipped vertical surfaces provide a natural weathered look while the planar upper and lower surfaces provide structural integrity.

The rails are formed to be about 6"x6" in cross-section and about 9' to 10' long. It is important that the rails be about 6"x6" in cross-section as that size provides adequate strength against breakage while keeping the weight of each rail at a workable level.

DESCRIPTION OF THE DRAWINGS

The invention will be more readily understood from a reading of the following specification and by reference to the accompanying drawings forming a part thereof, wherein an example of the invention is shown and wherein:

FIG. 3 is a perspective view of a section of a two rail granite fence of the invention.

FIG. 4 is a perspective view of two sections of an eight rail privacy granite fence of the invention.

FIG. 5 is an end view of the fence shown in FIG. 4.

DESCRIPTION OF A PREFERRED EMBODIMENT

Referring now in more detail to the drawings, the invention will now be described in more detail.

Rail fences have long been used as a means to enclose domestic animals, outline property boundaries to provide privacy and to enhance the appearance of property. A drawback to rail fences which are generally made of wood is maintenance, as wood deteriorates relatively rapidly. Rail fences made of metal or plastic are more maintenance free, however, there is an aesthetic problem and they are relatively expensive to build.

The fence of the invention attempts to overcome these problems and at the same time, provide a fence which has unique aesthetic properties.

Granite is one of the most enduring natural materials. It is both sturdy, does not deteriorate noticeably over hundreds of years and presents a uniquely strong and sturdy appearance. It has long been used in walls, buildings, bridges and roads which have stood over time. Due to expense and manufacturing difficulties, granite has not before now been used for forming rail fences before this invention.

A major problem with using granite is that normally there are no smooth surfaces on which to lay successive blocks. This problem is normally solved with concrete which is spread over engaging surfaces in varying thicknesses to provide overall contact and secure the abutting pieces together. When constructing fence post, this procedure is costly, time consuming and appearance changing.

Another major problem, because granite is very brittle and heavy, is the construction of a stone rail which is long enough and small enough to provide an adequate fence rail and yet strong enough to withstand handling without breaking. By cutting the rails to be about 6"x6" in cross-section and about 9' long, it has been found that they are both strong enough and yet light enough to handle.

Figure 1:
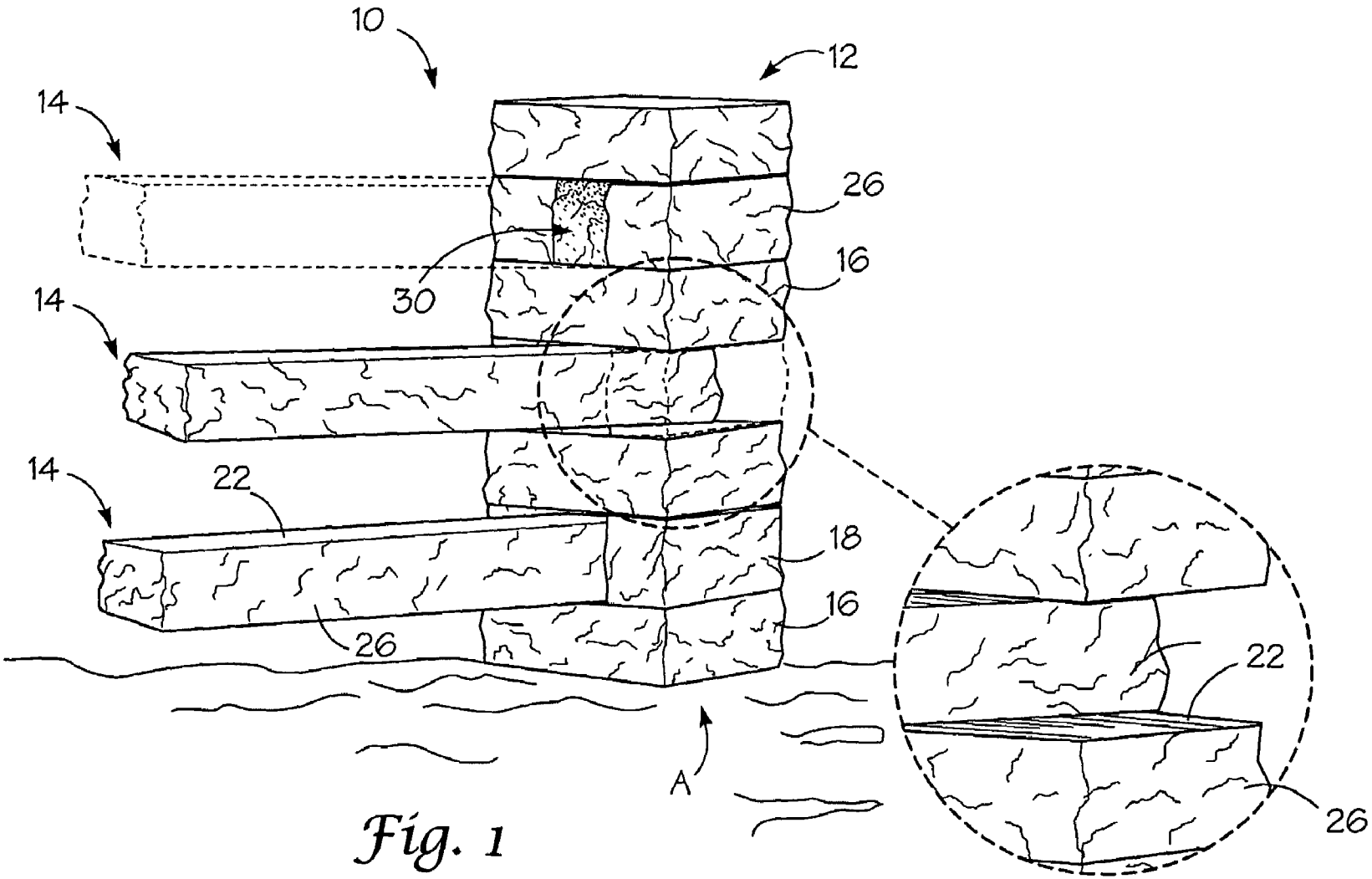
FIG. 1 is a sectional perspective view of a half section of a three rail granite rail fence of the invention.
Figure 2:
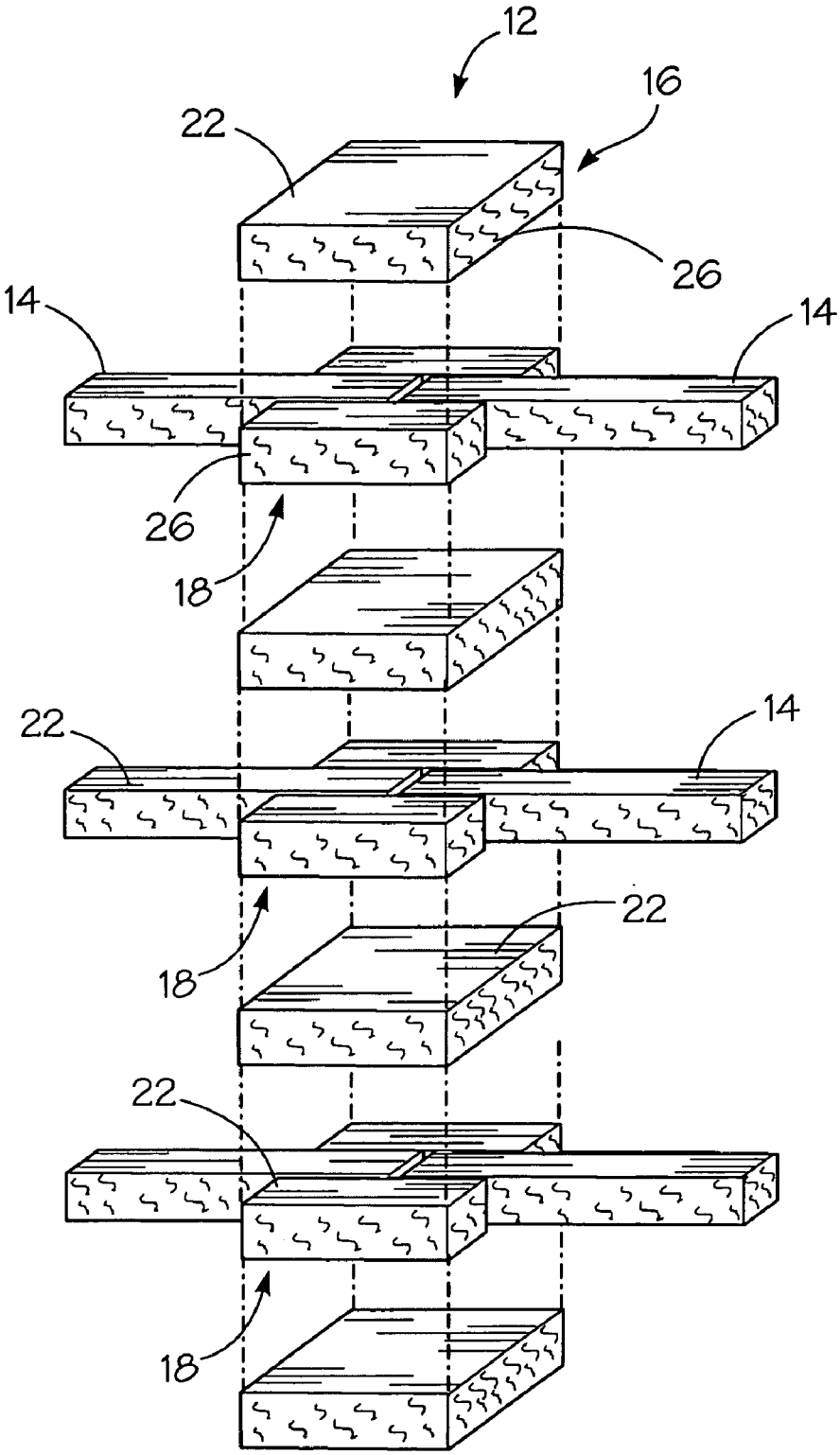
FIG. 2 is an exploded sectional perspective view of the post forming blocks as arranged to receive the granite rails.

Turning now to FIGS. 1–3 of the drawings, two versions of the rail fencing of the invention are shown.

In FIGS. 1 and 2, cutaway sections of rail fence 10, according to a first arrangement of the invention is shown. In this arrangement post 12 is formed to support three or six rails 14.

Each post 12 is constructed of a plurality of stone blocks stacked vertically and arranged to receive, at selected vertical intervals, ends of a selected number of rails 14. In FIG. 1, post 12 is an end post which supports three rails while in FIG. 2, post 12 is an intermediate post supporting six rails, three on opposing sides.

A foundation for each post is first established at spaced intervals. The foundation or footer may consist of anything from simply leveling the ground surface to packing the leveled ground surface to preparing a concrete footer.

The granite blocks, which comprise three size groups identified as 16, 18 and 20, are prepared with their upper and lower surfaces 22 processed by cutting as planar surfaces. The vertical sides and ends 26 of each block are processed by chipping to present a chipped or uneven surface. The granite rails are processed in similar manner, that is to present planar upper and lower surfaces 22 and chipped vertical side and end surfaces 26.

Blocks 16 are cut and chipped to be about 18" wide, 12" long, and 6" high. Blocks 18 are processed to be about 12" long, 6" wide and 6" high. These blocks are assembled in appropriate manner to form post 12, as shown in FIGS. 1–3.

The granite forming rails 14 are processed to provide that each rail have planar upper and lower surfaces 22, and chipped outer surfaces 26.

Foundation or footer A is prepared in any desired manner as above described. In the construction of post 12 as shown in FIGS. 1 and 3, a first block 16 is positioned on the foundation. If the foundation comprises a concrete footer, it may be desirable to coat the planar lower surface of the lower most block 16 with silicone which acts to adhere or secure the block with the footer. Usually only one or two of the larger blocks 16 are stacked in position before a pair of smaller blocks 18 are positioned forming slot 30. As shown in FIGS. 1 and 2, slots 30 are formed by positioning two blocks 18 in laterally spaced positions on a first block 16 and positioning a second block 16 on top of blocks 18.

Normally, a pair of post are formed simultaneously so that a pair of slots 30 are formed simultaneously on each post. At this point, opposed ends of a rail 14 are positioned in the adjacent slots. Next, a block 16 is positioned over blocks 18 and the ends of rail 14. The process continues until both post 12 and rails 14 are formed to the desired height. Silicone may be applied to the engaging planar surfaces of all blocks and rails to secure them in permanent positions.

As shown in FIG. 1, rail fence 10 may be a three rail fence or, as in FIG. 2, it may be a two rail fence. Both arrangements are constructed in similar fashion, the differences being the number of rails 14 and the number of post forming blocks 16 between the rails.

Turning now to FIGS. 4 and 5, a second arrangement of constructing a granite rail fence is shown. Here the granite rails form a fence which comprises a privacy fence 40. In this arrangement, post 42 are constructed of blocks 20 and end portions of rails 14.

Blocks 20 are formed to be about 12"x12" with a 6" height and planar upper and lower surfaces 22 as earlier described. Rails 14 are formed as previously described, that is with a 6"x6" cross-section, a pair of opposed planar upper and lower surfaces 22 and chipped vertical side surfaces 26. Again, about 9' is the preferred length.

Fence 40 is constructed by forming spaced base surfaces B from post 42 as earlier described. In this arrangement, a 6" wide base surface $B^1$ must be provided between adjacent post 42 to accommodate the lower most rail 14.

As shown in the drawings, the lower most block 20 is positioned adjacent the forward edge of adjacent base surfaces B. A rail 14 is then laid along the rear side of base surface B parallel with and adjacent spaced blocks 20 and over base surface $B^1$.

As before, if concrete or other hard surfaces form base B, acrylic compound can be spread over the planar lower of blocks 20 and rail 14 securing them in position.

Second blocks 20 are now placed over the upper end surfaces of rail 14 and half of the in-place block 20. A second rail 14 is now placed over the in-place half block 20 to extend between post 40. The above described stone fences are attractive, sturdy, enduring and are relatively inexpensive to produce. In all instances, the planar upper and lower surfaces 22 are positioned in horizontal positions to contact and secure with adjacent stones while the chipped surfaces 24 are positioned in horizontal positions to provide the desired rustic natural appearance.

As shown in FIGS. 4 and 5, this procedure continues until fence 40 is constructed to the desired height. Because upper and lower surfaces of rails 14 lie substantially along a common plane, fence 40 serves as a privacy fence.

While a preferred embodiment of the invention has been described using specific terms, such description is for illustrative purposes only, and it is to be understood that changes and variations may be made without departing from the spirit or scope of the following claims.

What is claimed is:

1. A method of forming a rail fence of granite including:

shaping by cutting and chipping a plurality of granite pieces to form granite blocks of a first size and second and largest size and granite rails of a desired height and thickness to have planar upper and lower surfaces and chipped side surfaces;

forming a plurality of laterally spaced fence posts of said granite blocks of said first and second sizes by stacking selected of said blocks with said planar surfaces of adjacent of said blocks in full contact with each other and positioning at least certain of said chipped surfaces in outwardly facing directions;

arranging said stacked blocks to form vertically spaced slots having planar lower surfaces by positioning two of said first size blocks between two of said second size blocks; and positioning opposing ends of said rails in said slots of adjacent of said fence posts with said planar surfaces of said rails in engagement with said planar surfaces of said slots and said chipped surfaces of said rails facing outward to form said rail fence with said rails extending substantially horizontally.

2. The method of claim 1 including securing said blocks together by applying silicone over said planar surfaces of said blocks.

3. The method of claim 1 including providing a foundation for said post by leveling the ground surface.

4. The method of claim 1 including arranging said vertically spaced slots along laterally spaced axes in alternating sequence.

5. The method of claim 4 including vertically spacing said slots by the thickness of said granite blocks and rails.

6. The method of claim 4 including positioning said rails in said spaced slots to obstruct vision through said fence.

* * * * *